United States Patent [19]

Akagi

[11] 4,367,846

[45] Jan. 11, 1983

[54] FUEL INJECTION VALVE ASSEMBLY FOR INTERNAL COMBUSTION ENGINES

[75] Inventor: Jiro Akagi, Oyama, Japan

[73] Assignee: Kawasaki Steel Corporation, Kobe, Japan

[21] Appl. No.: 218,430

[22] Filed: Dec. 19, 1980

[30] Foreign Application Priority Data

Dec. 25, 1979 [JP] Japan ..... 54-178650
Dec. 25, 1979 [JP] Japan ..... 54-178652

[51] Int. Cl.[3] ..... F02M 47/02
[52] U.S. Cl. ..... 239/96
[58] Field of Search ..... 239/96, 533.2–533.12

[56] References Cited

U.S. PATENT DOCUMENTS 2,639,193 5/1953 Wood, Jr. ..... 239/533.3
2,788,246 4/1957 Nichols ..... 239/96
2,959,360 11/1960 Nichols ..... 239/96
2,985,378 5/1961 Falberg ..... 239/96

*Primary Examiner*—Andres Kashnikow
*Assistant Examiner*—Paul A. Sobel
*Attorney, Agent, or Firm*—Balogh, Osann, Kramer, Dvorak, Genova & Traub

[57] ABSTRACT

An injection valve assembly for spraying fuel into a diesel engine by receiving accurately metered charges of the fuel under pressure from an engine-driven jerk pump. The fuel inlet of the valve assembly communicates via a check valve with a storage chamber, where each incoming charge of pressurized fuel is stored temporarily. The fuel outlet of the valve assembly, in communication with the storage chamber, is normally closed by a spring-biased needle valve member. Upon full accumulation of each fuel charge in the storage chamber the check valve automatically closes the fuel inlet thereby causing the needle valve member to be displaced under the fuel pressure against the bias of the spring and hence to open the fuel outlet. Another embodiment employs two needle valve members, one for the on-off control of communication between the storage chamber and the fuel outlet, and the other for the on-off control of the fuel outlet.

9 Claims, 4 Drawing Figures

FUEL INJECTION VALVE ASSEMBLY FOR INTERNAL COMBUSTION ENGINES

BACKGROUND OF THE INVENTION

This invention relates to a fuel injection valve assembly for internal combustion engines, and more specifically to such a valve assembly well adapted for use with a jerk pump for injection of fuel oil into a diesel engine.

The combination of jerk pump and injection valve assembly represents an example of fuel injection systems heretofore suggested and used for the delivery of fuel into internal combustion engines notably including diesel engines. Receiving successive metered charges of fuel from the jerk pump, the injection valve assembly must introduce the fuel into the engine combustion chamber against the highly compressed air at the end of the compression stroke, as required for combustion in the diesel cycle. Considerable pressure is also required to break up the fuel into the fine-spray pattern desired for good combustion.

A problem common to such conventional fuel injection systems arises from the fact that the fuel pumps are driven by the engine. Thus, upon decrease in engine speed, pump output and injection pressures decrease correspondingly, adversely affecting combustion and engine performance.

SUMMARY OF THE INVENTION

The present invention aims at the provision of an improved fuel injection valve assembly, for use with an engine-driven fuel pump, which demands no great pumping power for fuel injection under sufficiently high pressure. The improved valve assembly is capable, moreover, of fuel injection under no less pressure at low engine speed than at high engine speed.

Summarized broadly, the fuel injection valve assembly according to this invention includes a body having formed therein a storage chamber for storing each charge of pressurized fuel from a fuel pump. Reciprocably mounted within the body, needle valve means is spring biased to normally close the fuel outlet of the valve assembly. The needle valve means is adapted to be acted upon at least by the pressurized fuel accumulated in the storage chamber, for movement in a direction to open the fuel outlet against the bias of the spring means. Also included is a check valve for discommunicating the storage chamber from the fuel inlet immediately following the introduction of each charge of pressurized fuel into the storage chamber.

Thus, after each pressurized fuel charge is fed into and accumulated in the storage chamber, the check valve blocks the communication between the storage chamber and the fuel inlet. Thereupon the fuel pressure in the storage chamber acts to cause displacement of the needle valve means in the direction to open the fuel outlet, with the result that the accumulated fuel under pressure flows from the storage chamber to the fuel outlet and thence is sprayed out into the engine combustion chamber.

In one embodiment the needle valve means comprises a single needle valve member. Another embodiment employs two needle valve members, one for the on-off control of the fuel exit port of the storage chamber, and the other for the on-off control of the fuel outlet. The latter arrangement, in particular, has the advantage of positively closing the fuel outlet against fuel leakage.

As will have been understood from the foregoing, this invention provides for temporary storage or accumulation of each pressurized fuel charge in the injection valve assembly. Only upon completion of the delivery of each charge from the fuel pump is the accumulated charge sprayed into the engine. Injection pressure is therefore totally independent of engine speed. As an additional advantage the valve assembly according to the invention is less affected by the piping between itself and the fuel pump than the prior art, resulting in the avoidance of pressure drop and of the pitting and erosion of the parts due to cavitation. The invention also permits the use of a pump of smaller capacity than has been required heretofore.

The above and other objects, features and advantages of this invention and the manner of attaining them will become more apparent, and the invention itself will best be understood, from the following description of the preferred embodiment taken in connection with the attached drawings.

DESCRIPTION OF THE PREFERRED EMBODIMENTS

Figure 1:
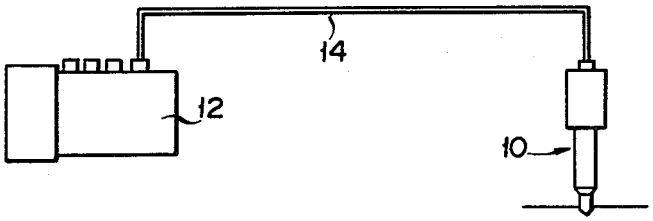
FIG. 1 is a diagrammatic representation of the fuel injection system incorporating the improved valve assembly in accordance with this invention.

With reference first to FIG. 1 there is shown at 10 the fuel injection valve assembly in accordance with this invention, for the introduction of diesel fuel into a diesel engine, not shown. The valve assembly 10 communicates with a jerk pump 12 of any known or suitable design by way of a conduit 14. Driven by the unshown diesel engine, the jerk pump 12 delivers successive accurately measured amounts of pressurized diesel fuel into the valve assembly 10.

Figure 2:
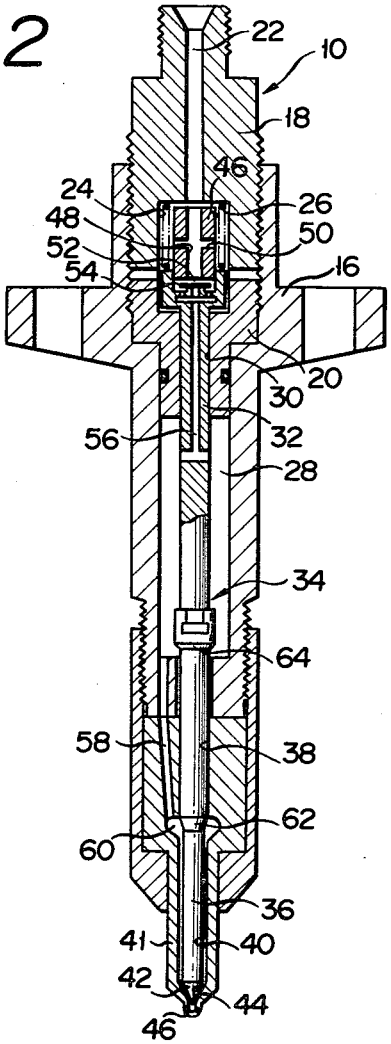
FIG. 2 is an enlarged axial sectional view showing in detail a preferred form of the fuel injection valve assembly in accordance with the invention.

FIG. 2 shows, on an enlarged scale and in axial section, a preferred form of the fuel injection valve assembly 10. It has a substantially tubular body or housing 16 with its top end pressure-tightly closed by a threaded plug or cap 18 and another threaded member 20. Although the threaded members 18 and 20 are shown as separate units, they can be considered integral with the body 16 for the purposes of this invention. The body 16, or its plug 18, has a fuel inlet 22 formed therein for communication with the jerk pump 12 by way of the conduit 14 as in FIG. 1.

Formed just under the fuel inlet 22 is a spring chamber 24 accommodating a helical compression spring 26. The body 16 has also formed therein a storage chamber 28 spaced downward from the spring chamber 24. A bore 30 extends between the spring chamber 24 and the storage chamber 28 to permit the upper portion 32 of a needle valve member 34 to slidably extend therebetween. The needle valve member 34 will hereinafter be referred to simply as the needle. The lower portion 36 of the needle 34 slidably extends through a bore 38 and, with clearance, through a fuel outlet passageway 40 in a nozzle 41 and terminates in a conical tip 42. Normally the tip 42 of the needle 34 is biased by the spring 26 into engagement with a valve seat 44 to close a fuel outlet opening or openings 46 at the tip of the nozzle 41. The spring 26 is in slight compression when the needle tip 42 is in engagement with the valve seat 44.

The upper portion 32 of the needle 34 is formed substantially integral with a plug member 46 having formed therein an inlet passageway 48 in constant communication with the inlet 22. Branch passageways 50 in the plug member 46 places the inlet 22 in constant communication with the spring chamber 24.

The needle 34 has a valve chamber 52 formed therein, or between its upper portion 32 and the plug member 46. A check valve 54 mounted in this valve chamber acts to permit fuel flow only from the inlet passageway 48 in the plug member 46 into another inlet passageway 56 extending through the needle upper portion 32 and opening to the storage chamber 28. Thus the storage chamber 28 temporarily stores each incoming charge of pressurized fuel, preparatory to its discharge through the outlet 46.

A fuel outlet passageway 58 extends downwardly from the bottom of the storage chamber 28 to a valve lift chamber 60 encircling a conoidal step 62 of the needle lower portion 36 and communicating with the fuel outlet 46 via the first mentioned outlet passageway 40. The pressurized fuel in the valve lift chamber 60 is effective to urge the needle 34 upwardly, away from the valve seat 44. The needle 34 has another conoidal step 64 located in the storage chamber 28. Thus the pressurized fuel in the storage chamber 28 also acts upon the needle 34 to urge same upwardly.

In operation each charge of pressurized diesel fuel from the jerk pump 12 enters the fuel injection valve assembly 10 through its inlet 22. Within the valve assembly the pressurized fuel is directed into the spring chamber 24 via the inlet passageway 48 and branch passageway 50 in the plug member 46 and further into the storage chamber 28 via the check valve 54 and the inlet passageway 56 in the upper portion 32 of the needle 34. The pressurized fuel also enters the valve lift chamber 60 via the outlet passageway 58 extending from the storage chamber 28.

The pressurized fuel thus stored in the storage chamber 28 and in the valve lift chamber 60 exerts upward forces on the conoidal steps 62 and 64 of the needle 34. The resultant of these upward forces is offset by the downward force exerted on the needle by the pressurized fuel in the spring chamber 24. Thus, during the delivery of each fuel charge from the jerk pump 12, the spring 26 holds the needle 34 bottomed against the valve seat 44.

Upon completion of the delivery of each fuel charge from the jerk pump 12 the fuel pressure rapidly drops in the spring chamber 24 and the inlet 48 and branch 50 passageways, with the consequent upward displacement of the check valve 54 to close the inlet passageway. The fuel in the storage chamber 28 and valve lift chamber 60 retains its pressure as the check valve 54 closes the inlet passageway 48. Since then the fuel pressure in the spring chamber 24 becomes approximately zero, the downward force of the spring 26 on the needle 34 is overcome by the resultant of the upward forces exerted thereon by the pressurized fuel in the storage chamber 28 and valve lift chamber 60. The result is the upward displacement of the needle 34, out of engagement with the valve seat 44, so that the pressurized fuel is injected in the form of droplets into the combustion chamber of the diesel engine through the outlet 46.

The fuel pressure in the storage chamber 28 and valve lift chamber 60 gradually decreases with the progress of such fuel spraying, until the force of the spring 26 overcomes the resultant of the upward forces acting on the conodial steps 62 and 64 of the needle 34. Thereupon the needle moves back into engagement with the valve seat 44 to close the fuel outlet 46. One cycle of fuel injection is now completed. The same cycle is repeated as the jerk pump 12 delivers successive charges of pressurized fuel into the valve assembly 10.

Figure 3:
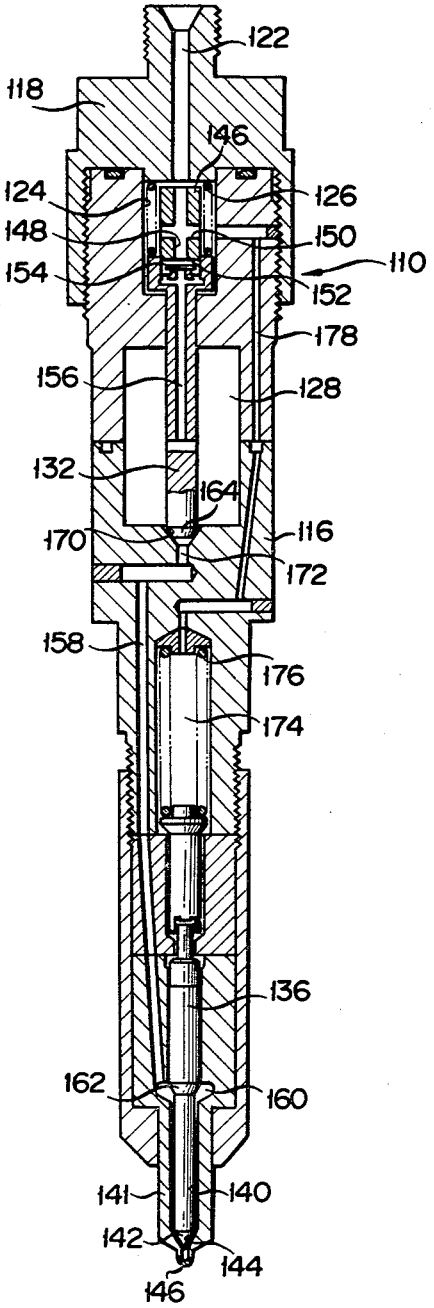
FIG. 3 is a view similar to FIG. 2 but showing another preferred form of the fuel injection valve assembly in accordance with the invention.
Figure 4:
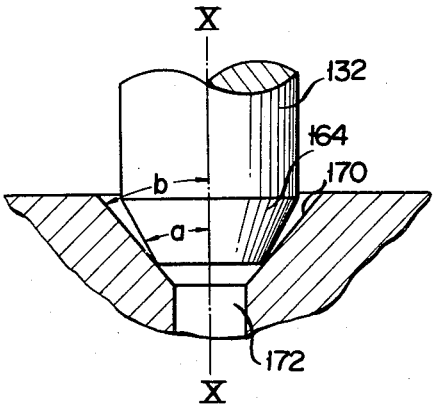
FIG. 4 is an enlarged, fragmentary sectional view explanatory of the way in which the upper needle valve member engages the valve seat in the valve assembly of FIG. 3.

FIGS. 3 and 4 illustrate another preferable form of the fuel injection valve assembly in accordance with the invention, which features two needles, instead of one in the preceding embodiment. The various parts of this alternative valve assembly will be identified by the same reference numerals as used to denote the corresponding parts of the valve assembly 10, but with the digit "1" prefixed to such numerals. Thus, for example, the alternative valve assembly 110 has two needles 132 and 136 as they correspond to the upper portion 32 and lower portion 36, respectively, of the needle 34 in the foregoing embodiment.

As seen in FIG. 3, the valve assembly 110 has a body 116 onto which there is threaded a plug or cap 118 having a fuel inlet 122. The body 116 has formed therein an upper spring chamber 124 and a storage chamber 128. Reciprocably extending between the two chambers 124 and 128, the upper needle 132 is formed substantially integral with a plug member 146 having forward therein an inlet passageway 148 and a branch passageway 150. The upper spring chamber 124 is in constant communication with the fuel inlet 122 by way of the passageways 148 and 150. A valve chamber 152 in the upper needle 132 accommodates a check valve 154, which permits fuel flow only from the inlet passageway 148 in the plug member 146 into another inlet passageway 156 formed in the upper needle to direct the pressurized fuel into the storage chamber 128.

Projecting into the storage chamber 128, the upper needle 132 terminates in a conoidal tip 164. An upper spring 126, mounted in slight compression in the upper spring chamber 124, normally urges this tip of the upper needle into engagement with a conoidal valve seat 170 which is formed at the bottom of the storage chamber 128 to define a fuel exit port 172.

As shown in more detail in FIG. 4, the angle a between the surface of the conoidal tip 164 of the upper needle 132 and its axis X—X is less than the angle b between the surface of the conoidal valve seat 170 and its axis X—X. The difference between the angles a and b is such that the upper needle tip 164 is in line contact with the valve seat 170. Thus the pressurized fuel trapped in the storage chamber 128 can act upwardly on the upper needle tip 164.

A fuel outlet passageway 158 communicates the exit 172 of the storage chamber 128 with a valve lift chamber 160, which in turn communicates with a fuel outlet 146 via another outlet passageway 140 in a nozzle 141. The lower needle 136 reciprocably extends between a lower spring chamber 174, disposed under the storage chamber 128, and the fuel outlet 146 through the valve lift chamber 160. The conical tip 142 of the lower needle 136 normally rests on a valve seat 144 under the bias of a lower compression spring 176 mounted in slight compression in the lower spring chamber 174, thereby closing the fuel outlet 146.

The lower needle 136 has a conoidal step 162 located in the valve lift chamber 160. The pressurized fuel in the valve lift chamber 160 acts on the step 162 to urge the lower needle 136 out of engagement with the valve seat 144. A bypass passageway 178 holds the lower spring chamber 174 in constant communication with the upper spring chamber 124 and therefore with the fuel inlet 122. Thus the lower spring 176 coacts with the pressurized fuel introduced into the lower spring chamber 174, to force the lower needle 136 into positive engagement with the valve seat 144.

In the operation of this alternative fuel injection valve assembly 110, each charge of pressurized diesel fuel from the jerk pump 12, FIG. 1, enters: (1) the upper spring chamber 124 via the inlet 148 and branch 150 passageways; (2) the storage chamber 128 via the inlet passageway 156; and (3) the lower spring chamber 174 via the bypass passageway 178. During such delivery of the pressurized fuel into the valve assembly 110 the upper needle 132 is held against the valve seat 170 under the bias of the upper spring 126 and under the fuel pressure in the upper spring chamber 124. With its exit port 172 thus closed by the upper needle 132 the storage chamber 128 accumulates the charge of pressurized fuel. The lower needle 136 is then likewise held against the valve seat 144 to close the fuel outlet 146 under the bias of the lower spring 176 and under the fuel pressure in the lower spring chamber 174.

The check valve 154 undergoes upward displacement upon completion of the delivery of each fuel charge from the jerk pump 2, thereby discommunicating the storage chamber 128 from the fuel inlet 122. The fuel pressures in both spring chambers 124 and 174 become approximately zero.

As will be seen from FIG. 4, the pressurized fuel accumulated in the storage chamber 128 exerts an upward force on the conoidal surface of the tip 164 of the upper needle 132. The fuel pressure in the valve lift chamber 160, developed by the previous charge from the jerk pump 12, also applies an upward force on the flat bottom surface of the upper needle tip 164. The residual fuel pressure in the valve lift chamber 160 is of course less than the accumulated fuel pressure in the storage chamber 128 and in practice may be approximately 200 kilograms per square centimeter ($kg/cm^2$).

The resultant of the two upward forces acting on the upper needle 132 is greater than the force of the upper spring 126, so that the upper needle moves out of engagement with the valve seat 170 thereby opening the exit port 172. Thereupon the pressurized fuel flows out of the storage chamber 128 and, via the outlet passageway 158, into the valve lift chamber 160. The pressurized fuel in this valve lift chamber 160 acts on the conoidal step 162 of the lower needle 136 thereby lifting same against the bias of the lower spring 176. With the fuel outlet 146 thus opened, the fuel is sprayed into the combustion chamber of the unshown diesel engine.

When the fuel pressure in the valve lift chamber 160 drops close to about 200 $kg/cm^2$ with the progress of fuel injection, the upper needle 132 is first sprung back into engagement with the valve seat 170, followed by the springing back of the lower needle 136 into engagement with the valve seat 144. This is because the resistive force of the upper spring 126 is made greater than that of the lower spring 176. The same cycle of operation is repeated thereafter as the jerk pump 12 delivers successive charges of pressurized fuel into the valve assembly 110.

It will be obvious to those skilled in the art that various modifications of the present invention may be resorted to in a manner limited only by a just interpretation of the following claims.

What is claimed is:

1. A fuel injection valve assembly for an internal combustion engine, comprising:

(a) a body having formed therein:
  (1) a fuel inlet for admitting successive charges of pressurized fuel;
  (2) a spring chamber in constant communication with the fuel inlet;
  (3) a storage chamber for storing each incoming charge of pressurized fuel; and
  (4) a fuel outlet for discharging in the form of droplets the pressurized fuel fed from the storage chamber;

(b) spring means in the spring chamber, (c) needle valve means mounted within the body for reciprocable motion between a first and a second position and extending between the spring chamber and the fuel outlet through the storage chamber and normally held under the bias of the spring means in the first position to close the fuel outlet, the needle valve means having:
  (1) an inlet passageway for the introduction of the pressurized fuel from the fuel inlet into the storage chamber; and
  (2) means adapted to be acted upon at least by the pressurized fuel stored in the storage chamber, the needle valve means when so acted upon being moved from the first to the second position against the bias of the spring means for opening the fuel outlet; and (d) a check valve for blocking the inlet passageway after each charge of pressurized fuel is introduced into the storage chamber from the fuel inlet.

2. The fuel injection valve assembly as recited in claim 1, wherein the needle valve means comprises a single needle valve member.

3. The fuel injection valve assembly as recited in claim 2, wherein the body has further formed therein a valve lift chamber disposed between and communicating with the storage chamber and the fuel outlet, and wherein the needle valve member has a surface adapted to be acted upon by the pressurized fuel in the valve lift chamber for movement from the first to the second position.

4. The fuel injection valve assembly as recited in claim 1, wherein the body has further formed therein:

(a) an outlet passageway for the delivery of the pressurized fuel from the storage chamber to the fuel outlet, the outlet passageway being closed by the needle valve means when the latter is in the first position; and (b) a valve lift chamber in constant communication with the outlet passageway, the needle valve means being adapted to be acted upon by the pressurized fuel in the valve lift chamber for movement from the first to the second position against the bias of the spring means.

5. The fuel injection valve assembly as recited in claim 4, wherein the needle valve means comprises:

(a) a first needle valve member extending from the fuel inlet into the storage chamber and having the inlet passageway formed therein, the first needle valve member closing the outlet passageway when in the first position; and (b) a second needle valve member for opening and closing the fuel outlet, the second needle valve member extending through the valve lift chamber and being adapted to be moved from the first to the second position by the pressurized fuel contained therein.

6. In combination with an engine-driven jerk pump, a fuel injection valve assembly comprising:

(a) a body having formed therein:

(1) a fuel outlet for admitting successive metered charges of pressurized fuel from the jerk pump;

(2) a spring chamber in constant communication with the fuel inlet;

(3) a storage chamber for temporarily storing each incoming charge of pressurized fuel; and (4) a fuel outlet in communication with the storage chamber for discharging the pressurized fuel in the form of droplets;

(b) a spring in the spring chamber;

(c) a needle valve member slidably mounted within the body for reciprocable motion between a first and a second position and extending between the spring chamber and the fuel outlet through the storage chamber, the needle valve member being normally retained by the spring in the first position for closing the fuel outlet, the needle valve member having:

(1) an inlet passageway for the introduction of the pressurized fuel from the fuel inlet into the storage chamber; and (2) means adapted to be acted upon at least by the pressurized fuel in the storage chamber, the needle valve member when so acted upon being moved from the first to the second position against the bias of the spring means for opening the fuel outlet; and (d) a check valve for blocking the inlet passageway after each charge of pressurized fuel is introduced into the storage chamber from the fuel inlet.

7. The fuel injection valve assembly as recited in claim 6, wherein the body has further formed therein a valve lift chamber in constant communication with the storage chamber, and wherein the needle valve member is adapted to be acted upon by the pressurized fuel in the valve lift chamber for movement from the first to the second position.

8. In combination with an engine-driven jerk pump, a fuel injection valve assembly comprising:

(a) a body having formed therein:

(1) a fuel inlet for admitting successive metered charges of pressurized fuel from the jerk pump;

(2) a first and a second spring chamber, the first of which is in constant communication with the fuel inlet;

(3) a storage chamber for temporarily storing each incoming charge of pressurized fuel, the storage chamber having an exit port defined by a valve seat;

(4) a valve lift chamber in communication with the exit port of the storage chamber; and (5) a fuel outlet in communication with the exit port of the storage chamber for discharging the pressurized fuel in the form of droplets;

(b) a first and a second spring mounted in the first and the second spring chamber respectively;

(c) a first needle valve member reciprocably extending between the first spring chamber and the storage chamber and having formed therein an inlet passageway for the introduction of the pressurized fuel from the fuel inlet into the storage chamber, the first needle valve member being biased by the first spring into engagement with the valve seat so as to be acted upon in a direction away from the valve seat by the pressurized fuel in the storage chamber and in the valve lift chamber;

(d) a second needle valve member reciprocably extending between the second spring chamber and the fuel outlet through the valve lift chamber and normally closing the fuel outlet under the bias of the second spring, the second needle valve member being adapted to be acted upon in a direction away from the fuel outlet by the pressurized fuel in the valve lift chamber; and (e) a check valve for blocking the inlet passageway after each charge of pressurized fuel is introduced into the storage chamber from the fuel inlet.

9. The fuel injection valve assembly as recited in claim 8, wherein the first and the second spring chambers are in constant communication with the fuel inlet.

* * * * *

UNITED STATES PATENT AND TRADEMARK OFFICE

CERTIFICATE OF CORRECTION

PATENT NO. : 4,367,846

DATED : January 11, 1983

INVENTOR(S) : Jiro AKAGI

It is certified that error appears in the above-identified patent and that said Letters Patent is hereby corrected as shown below:

Item [73] should read

Assignee: --Kabushiki Kaisha Komatsu Seisakusho, Tokyo, Japan--.

Signed and Sealed this

First Day of November 1983

[SEAL]

*Attest:*

GERALD J. MOSSINGHOFF

*Attesting Officer*

*Commissioner of Patents and Trademarks*